US005124960A

United States Patent [19]

Miller et al.

[11] Patent Number: 5,124,960

[45] Date of Patent: Jun. 23, 1992

[54] EVENT REGISTER DEVICE

[76] Inventors: Jeffrey P. Miller, 11105 Broad Green Dr., Potomac, Md. 20854; Robert L. Tesler, 14837 Fireside Dr., Silver Spring, Md. 20904

[21] Appl. No.: 458,025

[22] Filed: Dec. 28, 1989

[51] Int. Cl.[5] ..... G04B 37/00

[52] U.S. Cl. ..... 368/278; 368/113; 368/107

[58] Field of Search ..... 368/228, 286, 10, 69, 368/70, 101, 102–106, 113

[56] References Cited

U.S. PATENT DOCUMENTS

| | | | |
|---|---|---|---|
| 3,898,886 | 8/1975 | Hamm . | |
| 4,220,996 | 9/1980 | Searcy . | |
| 4,223,211 | 9/1980 | Allsen et al. . | |
| 4,281,389 | 7/1981 | Smith . | |
| 4,309,599 | 1/1982 | Myers . | |
| 4,387,437 | 6/1983 | Lowrey et al. . | |
| 4,396,296 | 8/1983 | Stodden | 368/101 |
| 4,396,904 | 8/1983 | Hanaoka . | |
| 4,402,147 | 9/1983 | Wu . | |
| 4,578,769 | 3/1986 | Frederick . | |
| 4,652,141 | 3/1987 | Arai | 368/278 |
| 4,700,369 | 10/1987 | Siegal et al. . | |
| 4,741,001 | 4/1988 | Ma . | |
| 4,993,004 | 2/1991 | Loizeaux | 368/107 |

OTHER PUBLICATIONS

Exhibit A.

*Primary Examiner*—Bernard Roskoski

*Attorney, Agent, or Firm*—Lowe, Price, LeBlanc & Becker

[57] ABSTRACT

A personal memory aid device and a pressure sensitive transducer which are both adapted to be worn at differing locations on an operator for the purpose of conveniently registering desired events. Actuation of the pressure transducer, either by a simple motion of the operator or by contact of the operator with another object, causes storage of information, such as an event count, concerning the an event defined by such actuation to be stored for concurrent or later communication to the operator. Wired and microwave links are provided for signalling between the transducer unit and the housing. A preferred embodiment is arranged to be implemented in combination with timekeeping circuitry and to be worn on the wrist of the operator in the manner of a wrist watch. The memory aid device is particularly adapted for use during athletic activity by the provision of a waterproof case.

12 Claims, 14 Drawing Sheets

EVENT REGISTER DEVICE

TECHNICAL FIELD

This invention relates to storage devices for registering events. More particularly, this invention is directed to the incremental registering of desired events as a memory aid, particularly during physical activities.

BACKGROUND ART

There are many activities in which it is desireable to count events or items. However, where the occurrence of such events or items is irregular or of relatively low frequency (for example, separated by more than a few seconds) or where, as in athletic activities, other matters must be concentrated upon, memory aids are often desireable to enhance the accuracy of the counting operation or to enhance the ability to concentrate on such other matters while maintaining an accurate count of the events or items. It is also often desireable to maintain information concerning such events or items and their occurrence such as the elapsed time between particular ones of a sequence of events or items.

For this purpose, many types of registers have been developed in the past. Such registers have included devices including thumbwheels with detents, mechanical counters and the like. Such known devices suffer from at least one of two principal drawbacks, especially for use as a personal memory aid during athletic activity, in that they are limiting of full participation in other activities in order for their required transportation or actuation or both. For example, a thumbwheel register, such as has been used by baseball umpires must be held in the hand and, even if affixed to the operator's body in some way, requires a manipulation which, although relatively simple, remains sufficiently complex to be distracting in other activities, thereby interfering with full performance of such activity.

On the other hand, other personal performance registering devices have been known in the past. Such devices usually include some integrating arrangements such as pedometers which, when calibrated for length of stride, output the measured quantity in other terms, such as distance covered in larger units such as miles or kilometers. Other similar devices are known which measure the duration of short intervals of relatively regular occurrence, such as the time between heartbeats, to report pulse rate during athletic activity. The former kind of device was often relatively bulky and potentially interfered with athletic performance while the latter required continual monitoring of the display by the operator to determine performance. Both suffered from the inability to register the performance or the occurrence of events arbitrarily occurring during the course of an activity (such as laps around a track or across a swimming course) as opposed to events occurring as a part of the activity (such as steps, heartbeats, etc.).

Event counters, per se, for use in swimming and track events are also known, but in a form which is adapted to the facility (track, pool, etc.) rather than the operator and, hence are not suitable for personal performance reporting use.

A further problem has been encountered in known electronic devices which have the potential for being made less inhibitory of athletic performance in a personal device in that moisture deriving from either the perspiration of the operator or from the environment, such as rain or the water in which swimming is performed often degrades the performance of the device or renders it inoperable.

DISCLOSURE OF THE INVENTION

It is therefore an object of this invention to provide an event register suitable for being worn on the body of an operator which overcomes the above-noted drawbacks by allowing actuation with the simplest of motions or even automatically during the performance of an activity and which is light in weight and non-encumbering.

It is a further object of this invention to provide a waterproof housing for such a personal event counter.

It is another object of this invention to provide an arrangement wherein information concerning an event can be stored in association with the event.

It is a yet further object of this invention to provide an event register in which the mode of operation can be altered during the performance of the activity by an action of the operator which will cause minimal interference with the activity.

It is yet another object of the invention to provide a wireless transmitter and link suitable for use in a personal event counter.

It is an additional object of the invention to provide a convenient means of attachment of both the digit switch module and the housing of the invention to the body of the operator as a single unit.

In accordance with one aspect of the invention, a personal memory aid is provided including a housing adapted to be worn by an operator at a first location on said operator, at least one signal producing device adapted to be worn at a second location on said operator, a receiver in the housing for receiving the signal so produced, a register for storing information in response to the output of the receiver and means for reporting the contents of the register to the operator.

In accordance with another aspect of the invention, a novel waterproof housing is provided in which all circuitry is hermetically sealed and battery access is provided by a screw closure.

In accordance with a further aspect of the invention, a wireless transmitter and data link are provided by a miniature microwave transmitter hermetically sealed with a digit switch mechanism.

In accordance with a yet further aspect of the invention, a glove-like arrangement is provided to attach both the housing and digit switch module to the body as a single unit in which the glove-like arrangement also provides the communication link therebetween.

These and other objects and advantages of the present invention will become apparent to those skilled in the art in light of the following detailed disclosure of the preferred embodiment of the invention.

BEST MODE FOR CARRYING OUT THE INVENTION

Figure 1A:
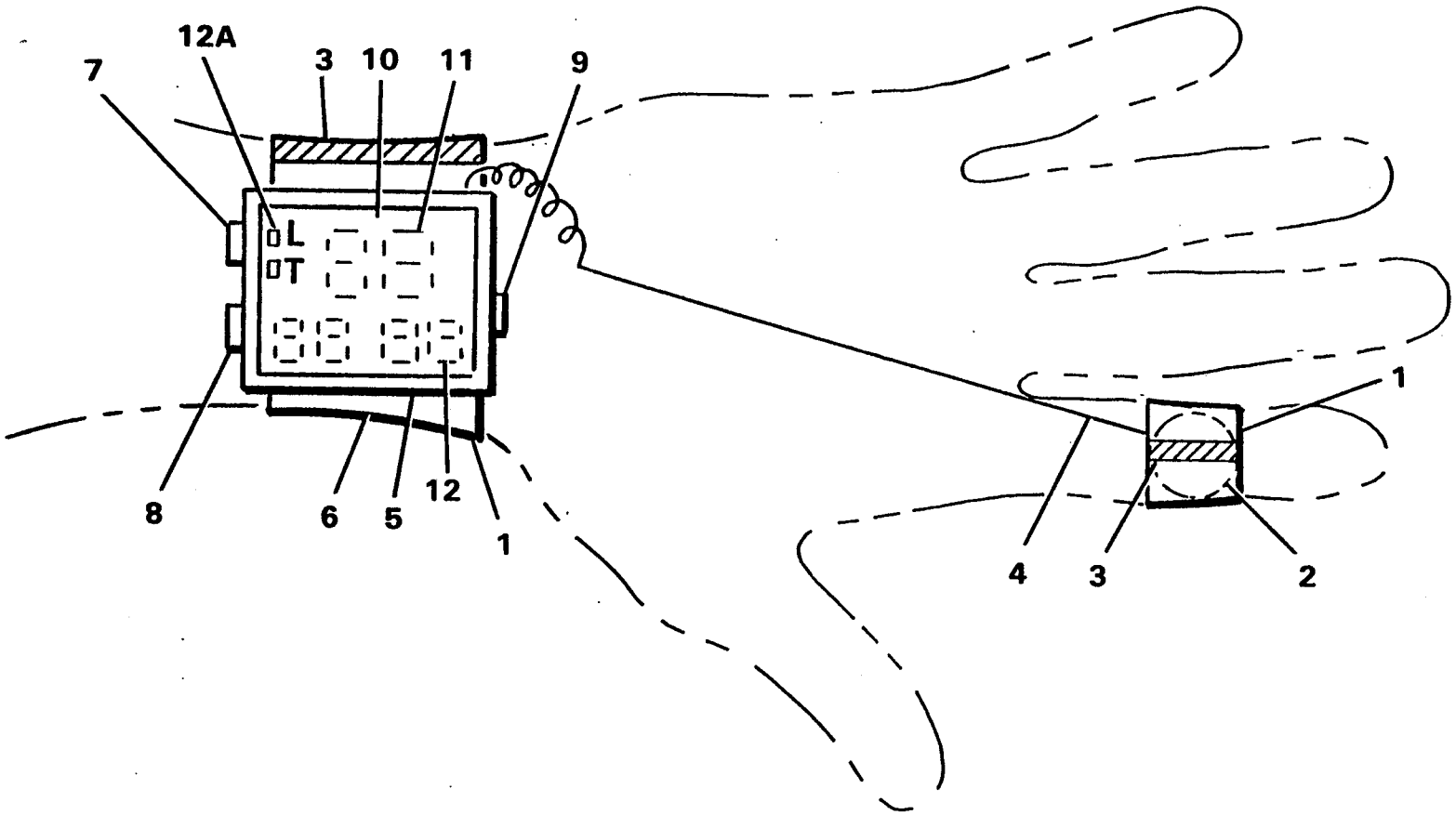
FIGS. 1A and 1B are views of a preferred form of the memory aid device as worn by an operator.
Figure 1B:
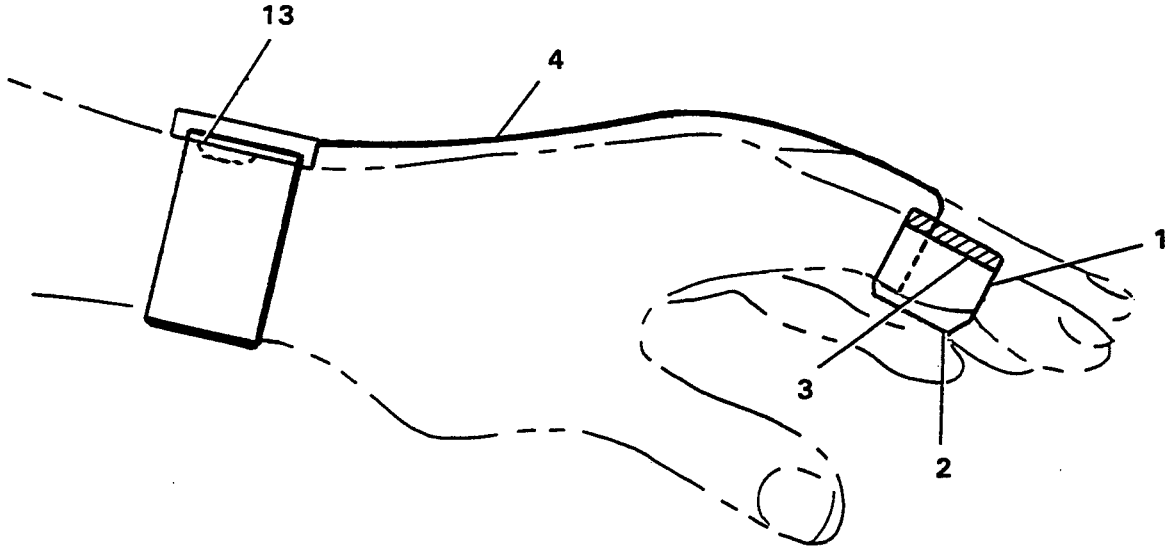
Figure 1C:
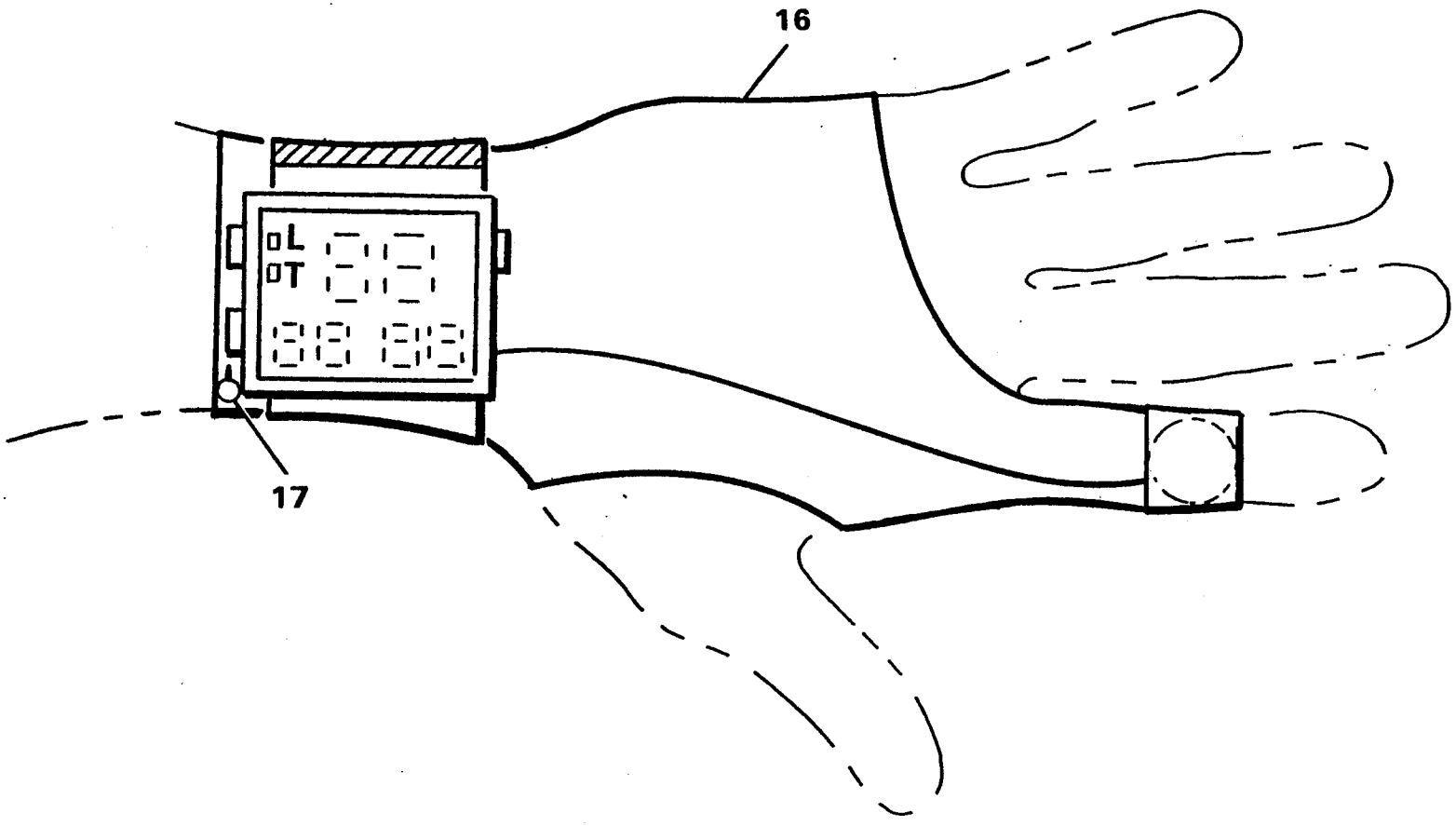
FIG. 1C shows an alternative form of attachment of the invention to the body of the operator.

A preferred embodiment of the invention is shown in FIGS. 1A and 1B as worn in a preferred manner by an operator on either hand. The event counter is preferably contained in a housing 5 with timekeeping circuitry in the form of a wristwatch. A transducer module, which will be referred to hereinafter as a digit switch module 2, is preferably worn around the index finger at a point where it can easily be reached by the thumb. It may be desireable to place the digit switch module at the end of a finger or at any other convenient point of the body for registration of contacts with other objects, as well. Both the housing unit and the digit switch module are preferably mounted on respective bands 1, 6 with Velcro (TM) closures 3 to securely fasten them closely to the body. Of course, these bands may be of any length which is suitable to encircle the portion of the body on which the operator desires to wear the respective units. The bands may also be formed of a stretchable elastic or elasticized material such as rubber or a stretchable fabric either with or without a closure formed of Velcro (TM) or other types of closures, as may be convenient or desireable. Alternatively, as shown in FIG. 1C, both the housing and the digit switch module can be attached to the body as a single unit by attaching both to a glove-like article 16. This article is preferably a lightweight mesh half-glove in which the wired link 4 between the digit switch module and the housing can be embedded or woven within the fabric of the glove. Redundant connections can also be made within the glove or within the fabric thereof to enhance reliability of the link. The glove will preferably be of a stretchable material and have an elastic strap or closure 17 at the wrist to improve the security of the attachment to the body of the operator. Similar garment-like arrangements suitable for attachment to other parts of the body would also provide similar advantages and are deemed to be within the scope of this invention. Wearing the housing as a pendant from the neck of the operator is also possible and may provide convenience in some situations where communication to another person is desireable such as in anaerobic exercises where verbal communication would interfere with the activity.

As further illustrated in FIG. 1A, a link 4 is provided to enable communication between the digit switch module and the housing. This link is wireless in one preferred embodiment of the invention, as will be discussed below, or, if wired, preferably detachable at the housing to enable the invention to also be used as a wristwatch, per se, which can be worn on either hand as desired. The housing further includes a mode select switch 7, set/reset switch 8 and load select switch 9 to allow selection of operation mode and the performance of other normal watch functions. A display unit 10, preferably consisting of two large digits 11 for event count, minutes in elapsed time mode and hours in normal mode and four smaller digits 12 with a colon/decimal point for seconds and fractions of seconds (e. g. hundredths) in elapsed time mode and minutes and seconds in normal mode is also provided in the housing. Two indicators 12A are provided to inform the user of the operational mode such as the "laps" mode or the "elapsed time" mode into which the event counter has been placed. These indicators are preferably of the form of icons or alphabetic characters corresponding in a simple manner to the name of the particular current operational mode, such as "L" for the "laps" mode and "T" for the "elapsed time" mode. Either the housing or digit switch module may also contain a tactile transducer 13, generally indicated in FIG. 1B to communicate the reaching of predetermined event counts in a manner similar to audible alarms in conventional electronic watches.

It is desirable that the housing be hermetically sealed so as to be waterproof, particularly since the invention is most preferably intended for use as a lap counter for use in swimming. It this regard, since the digit switch may also be used to switch between modes, it is possible to facilitate waterproofing by elimination of switches 7, 8 and 9 by using only the digit switch module to perform the function of these buttons. This is a particularly desireable configuration when used with attachment arrangements similar to the half-glove attachment arrangement described above where the housing and digit switch are effectively combined as a single unit by the attachment arrangement. As another alternative, plural transducers corresponding to switches 7, 8 and 9 may be included in the digit switch module 2 or additional digit switch modules. This alternative is also especially suited to the half-glove arrangement shown in FIG. 1C where the half glove could include more than one "finger" or a portion arranged to surround more than one of the operator's fingers, as in a mitten.

The preferred operation of the invention will now be described with particular reference to the functional block diagram of FIG. 2. A power supply 29 is provided to supply a voltage to each of the elements illustrated through connections which are not illustrated in this figure in the interest of clarity but which are accomplished in a conventional fashion. A free running clock 22 provides outputs to all circuits which require the input of clock pulse edges for operation, including the time of day clock counter and the elapsed time counter.

Figure 3A:
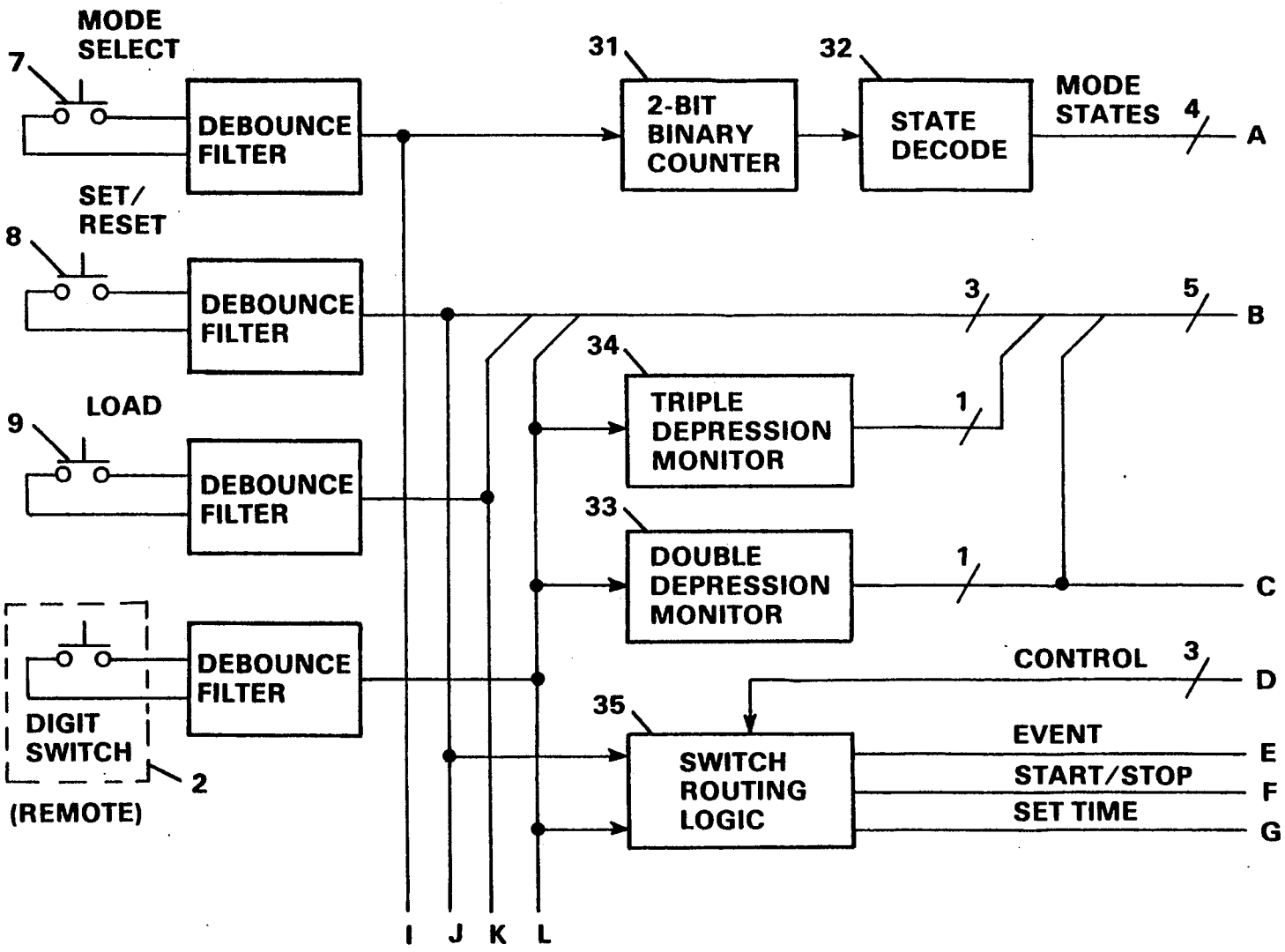
FIGS. 3A, 3B, 3C, and 3D taken together, form a detailed block diagram of a preferred embodiment of the invention.

Switches, comprising the digit switch module and switches 7, 8 and 9, if used, and associated debouncing circuits more particularly shown in FIG. 3A, are generally indicated at 20. The output of such switch or switches is provided to state monitor 21 which evaluates the number of and interval between switch actuations, stores the desired state in response to such actuations and routes signals from the switch or switches to other functional elements in dependence on the stored desired state. An output of state monitor 21 is provided to mode select and control element 23 which provides enabling signals to event counter 24, elapsed time counter 25, time of day clock 26 and display selector 27 Under control of mode select and control element 23, display selector 27 gates outputs of event counter 24, elapsed time counter 25 and time of day clock counter 26 to either the display 28 or tactile indicator 28*a*.

In the following discussion of the operation of the invention, it will be assumed that switches 7, 8 and 9 are used. However, attention is called to the digit switch actuation timing since time interval discrimination as monitored by circuits 33 and 34 in FIG. 3A is the preferred mode of distinguishing between desired control to be exercised by actuation of the digit switch and multiple actuation within given intervals, say, double actuation within one second could be used for reset and triple actuation within a similar or another interval could be used for mode switching or incrementing in a manner similar to the preferred embodiment disclosed.

Figure 2:
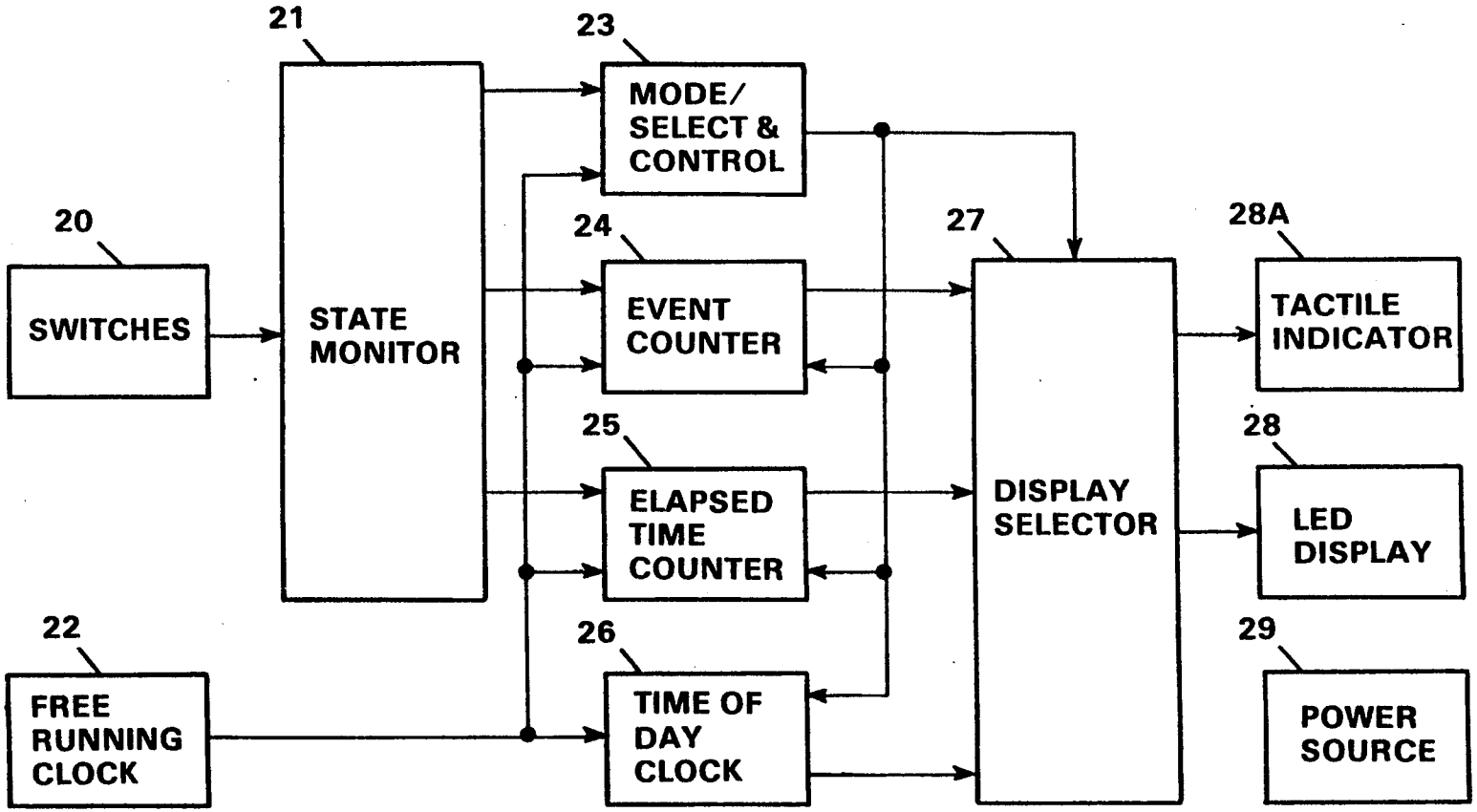
FIG. 2 is a functional block diagram of a preferred embodiment of the invention.
Figure 3B:
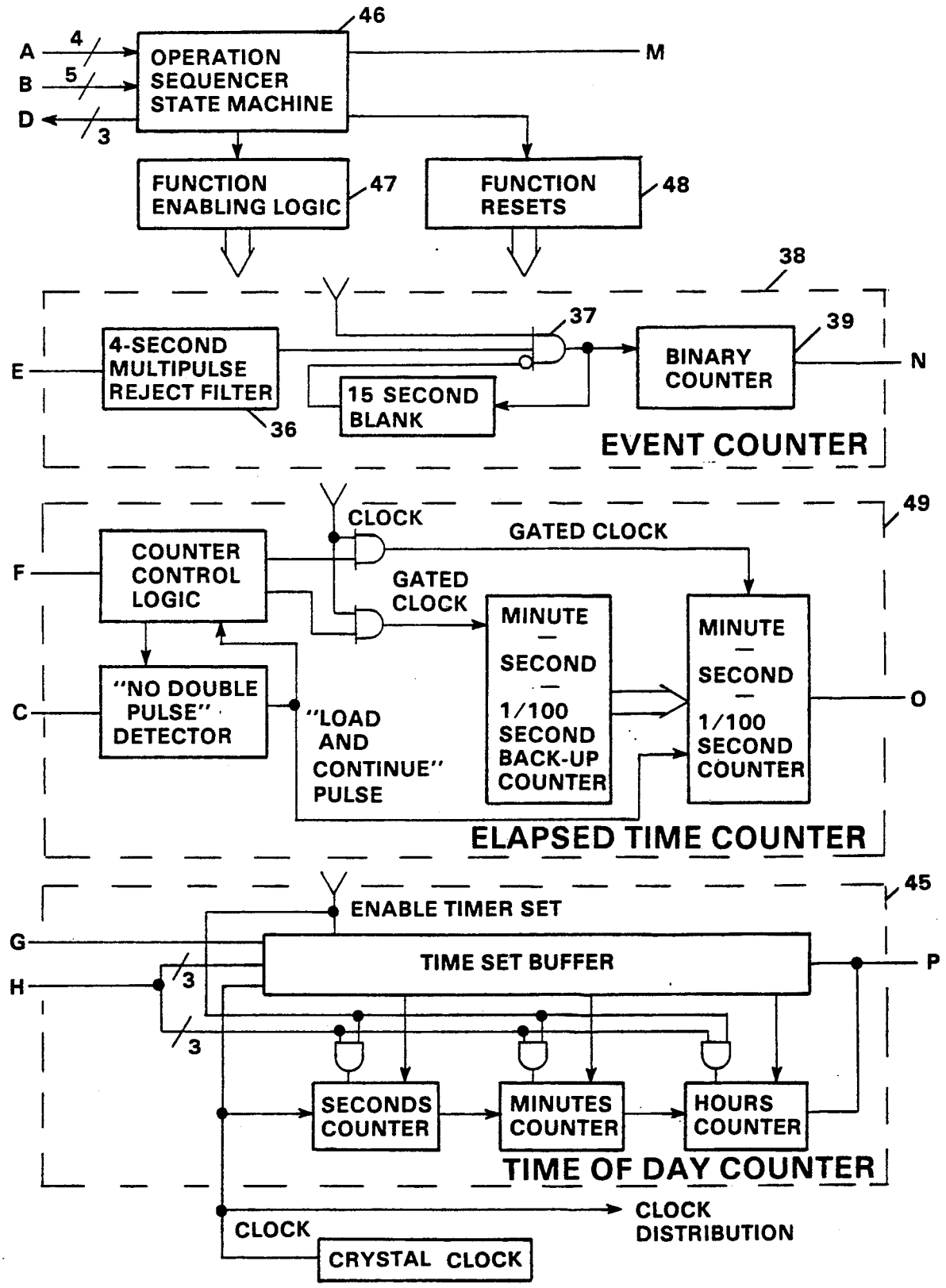

As shown in FIGS. 2 and 3B, the preferred embodiment of the invention includes generally conventional timekeeping circuitry including a time of day counter 45 and an elapsed time counter 49 which operate in a manner well-understood in the art. During setting, if the load switch or the set/reset switch are not pressed for a period of fifteen seconds, normal time of day display mode will be resumed. In the elapsed time mode, depression of the digit switch will start the timer and enable the display for thirty seconds. A double depression at about a two second interval will stop the timer and also enable the display for thirty seconds. This timed double depression is used to ensure that the operator intends to stop the timer. However, for measurement accuracy, the time displayed will be the time measured to the first of these digit switch depressions. Redisplay after thirty seconds is accomplished by depression of the load switch. Further depressions of the digit switch, as described, will alternately start and stop the timer. Depression of the set/reset switch will stop the timer and reset it to zero. If the elapsed time counter overflows, time of day mode will be resumed.

In using the event counter, the event counter mode is selected by incrementing the mode counter 31 as shown in FIG. 3A with the mode switch. While in this mode, the elapsed time will also be monitored as a background function. A first depression of the digit switch arms the event counter through operation sequencer 46 as shown in FIG. 3B and function enabling logic 47 which delivers a signal to the enable count input of AND gate 37. This switch depression also starts the elapsed time counter by delivery of a similar enable signal. Event counter circuit 38 includes a four second multiple pulse rejection circuit 36 to reject all input signals which may be intended as control signals. The event counter circuit also includes a fifteen second timer (such as a monostable circuit) which delivers a signal to an inverting input of AND gate 37 to reject all signals having an interval of less than fifteen seconds. This fifteen second interval is arbitrary and this preferred value is so chosen to improve operating margins and in view of the preferred use as a swimming lap counter. Each further depression of the digit switch increments the event counter 39 and enables display of the number of events for 15 seconds. Depressing the digit switch twice with approximately a two second interval between depressions will cause the elapsed time to be displayed with no incrementing of the event counter due to such further depressions. The elapsed time will be displayed for, preferably, fifteen seconds. Depressing the load switch while in this mode causes the elapsed time to be held and displayed and the event number to be stored. During this display of elapsed time, a further depression of the digit switch will not be counted as an event but will cause resumption of elapsed time monitoring and the event counting function. During display of elapsed time while in the event monitor mode, the event number and the elapsed time will be alternately displayed for several seconds each under control of multiplexer 52, shown in FIG. 3C. While in the event monitor mode, time of day may be displayed by depressing the digit switch three times within four seconds. In the event monitor mode, the counting of events will continue as described above until a new mode is selected or the set/reset switch is depressed. Overflow of the elapsed time counter 49 will cause reversion to the time of day mode or a shorter period may be established by provision of a shorter interval counter.

Figure 3C:
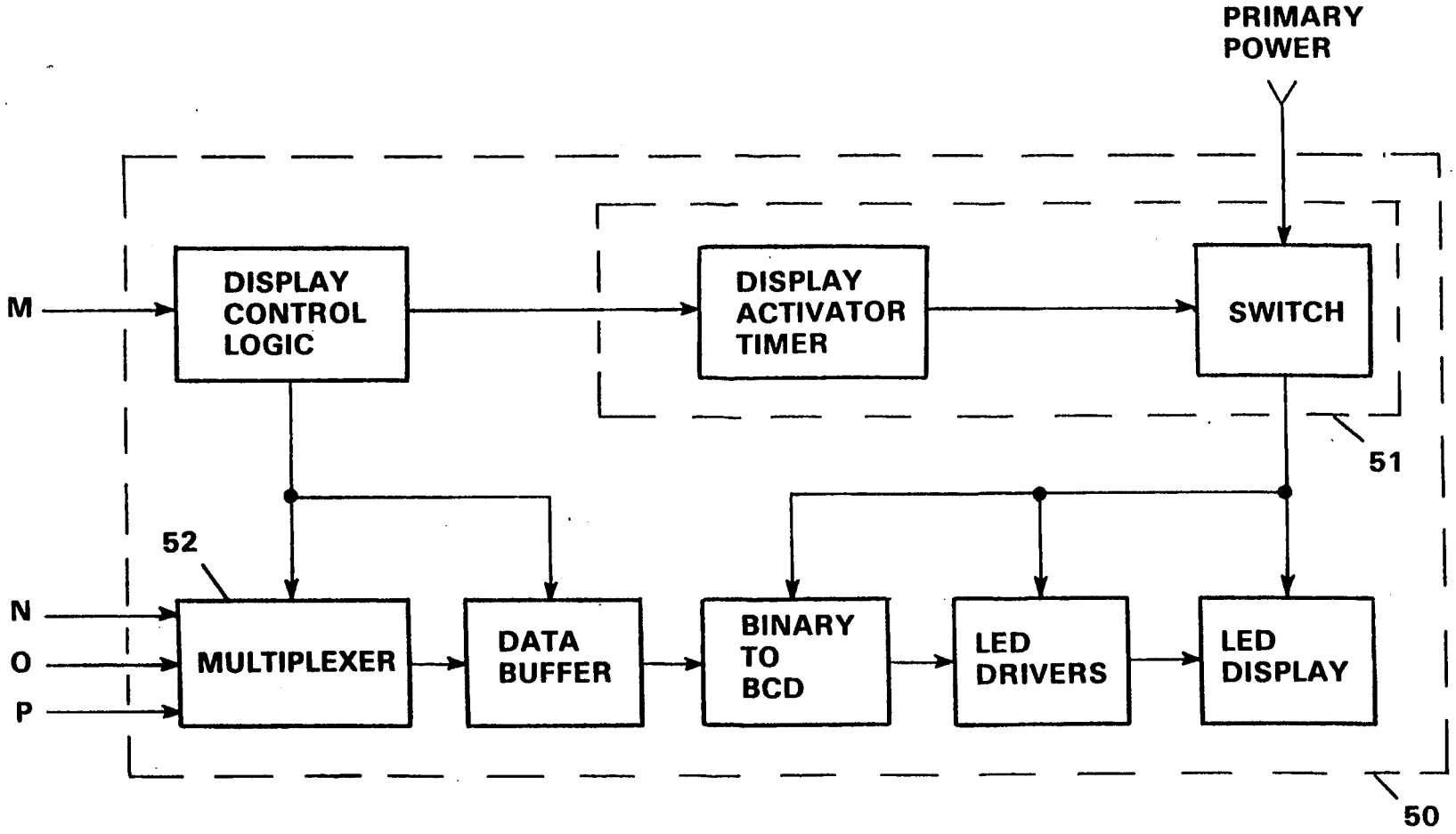
Figure 3D:
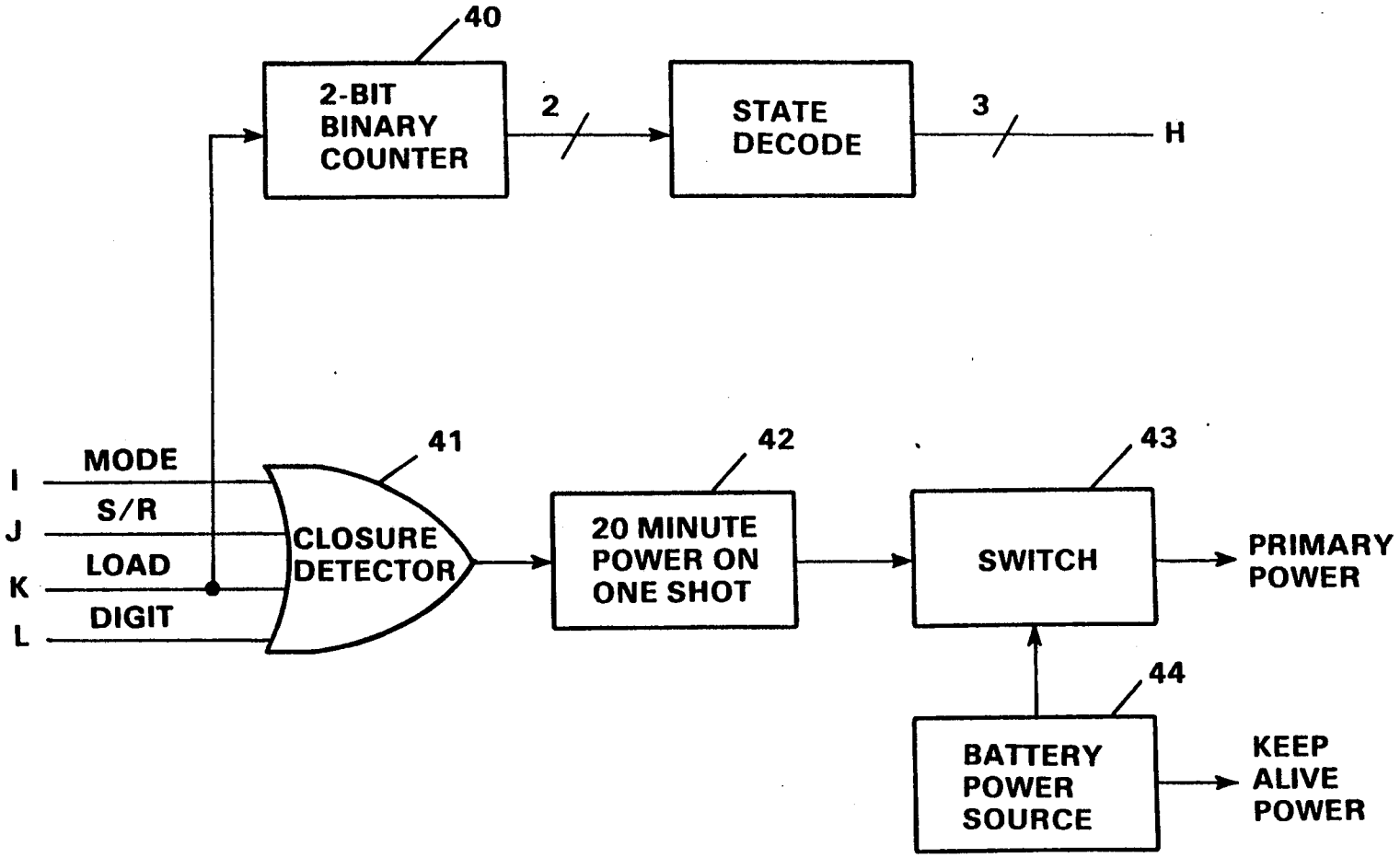

Referring now to FIG. 3D since it is contemplated that the invention will be used for a personal event counter during recreational athletic activity, and may have substantial standby periods when it is not is use, a power saving circuit is preferably included. OR gate 41 responds to any switch closure by supplying a signal to a twenty minute one-shot multivibrator 42. Two power distribution systems are provided from battery power source 44, one for providing standby power to the free running clock and other circuitry which can be kept energized and functional with low power drain and a primary power distribution system for the display, which preferably uses light-emitting diode (LED) indicators for high visibility and contrast in a variety of ambient light conditions but which also have relatively high power consumption, and portions of the circuitry associated with active use such as the event counter, elapsed time counter, the mode select and control element and the state monitor itself. The output of one-shot 42 controls switch 43 to connect power from battery source 44 to the primary power distribution system for these latter elements of the invention as seen in FIG. 3C. Additional power saving is effected via the led power control circuits 51.

Figure 4:
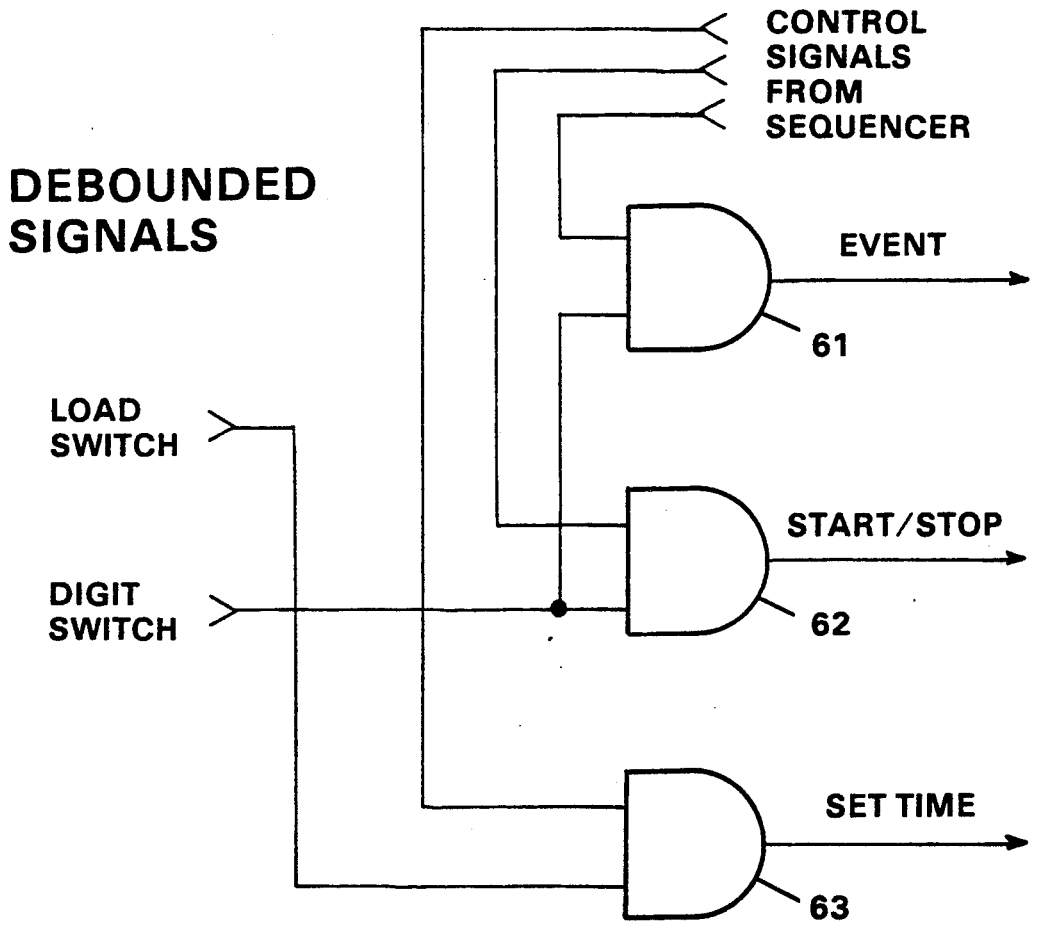
FIG. 4 is a detail diagram of the Switch Routing Logic functional block 35, shown in FIG. 3A.

Switch routing logic 35 of FIG. 3A will now be more particularly described with reference to FIG. 4. In an exemplary form, according to a preferred embodiment of the invention, switch routing logic need be no more than an array of AND gates, each receiving an input from a corresponding switch and another input from the operation sequencer 46. It will be understood that other logic arrangements could be used within the level of present skill in the art and, particularly if deemed advantageous for purposes of circuit layout, could include a decoder responsive to other outputs of the operation sequencer, in which case, further complexity of the switch routing logic would permit simplification of the operation sequencer 46. In the above description of the operation of the invention for display of elapsed time during the event monitor mode, it was noted that the digit switch was used to resume event counting without that actuation being counted as an event. As can be seen in FIG. 4, the debounced output from the digit switch is provided to both gates 61 and 62. Differential routing of this signal to the event counter 38 and the start/stop input of the elapsed time counter 49 is therefore done under control of the operation sequencer 46.

Figure 5A:
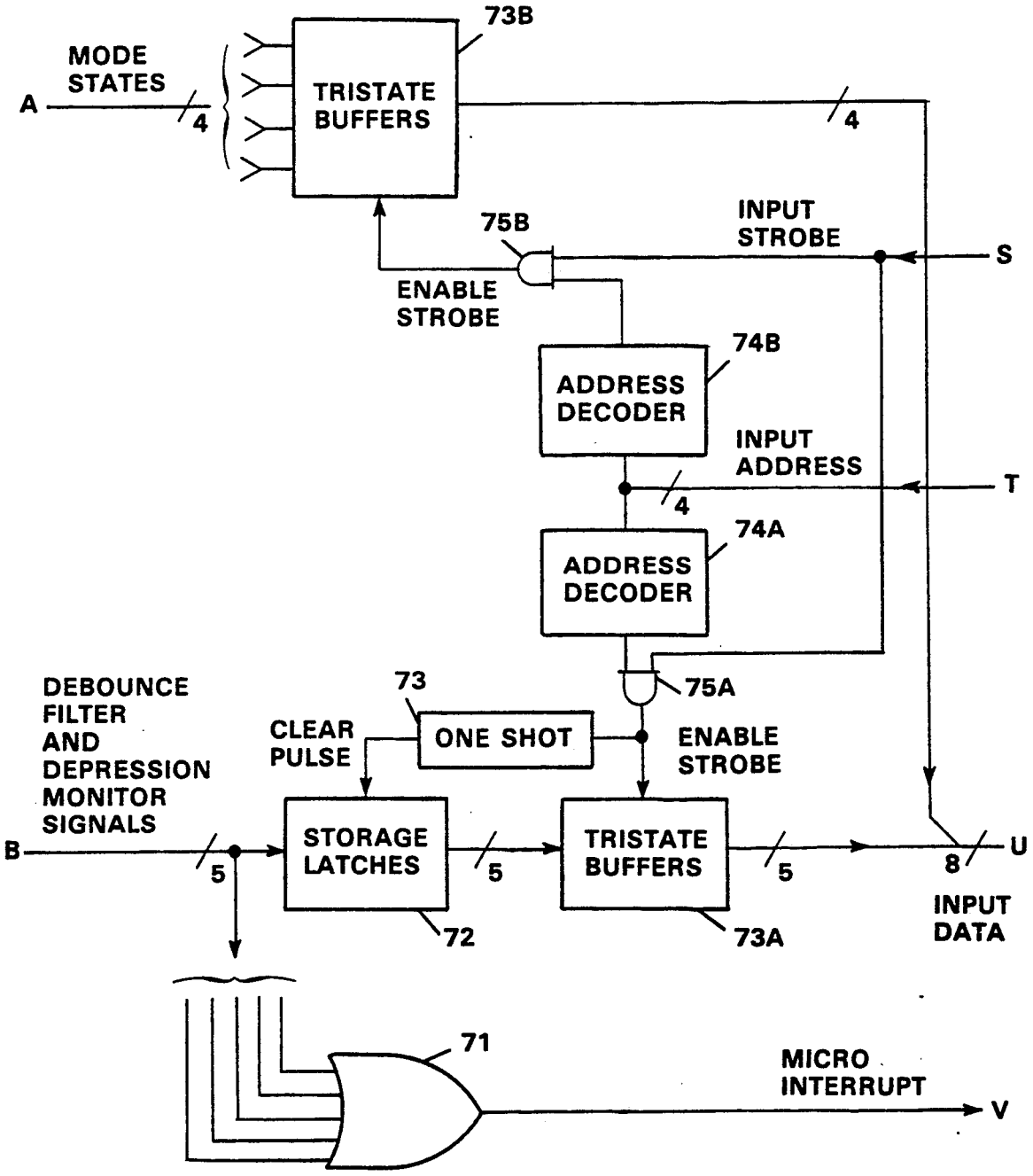
FIGS. 5A and 5B, taken together, form a detail diagram of the Operation Sequencer functional block 46, shown in FIG. 3B.
Figure 5B:
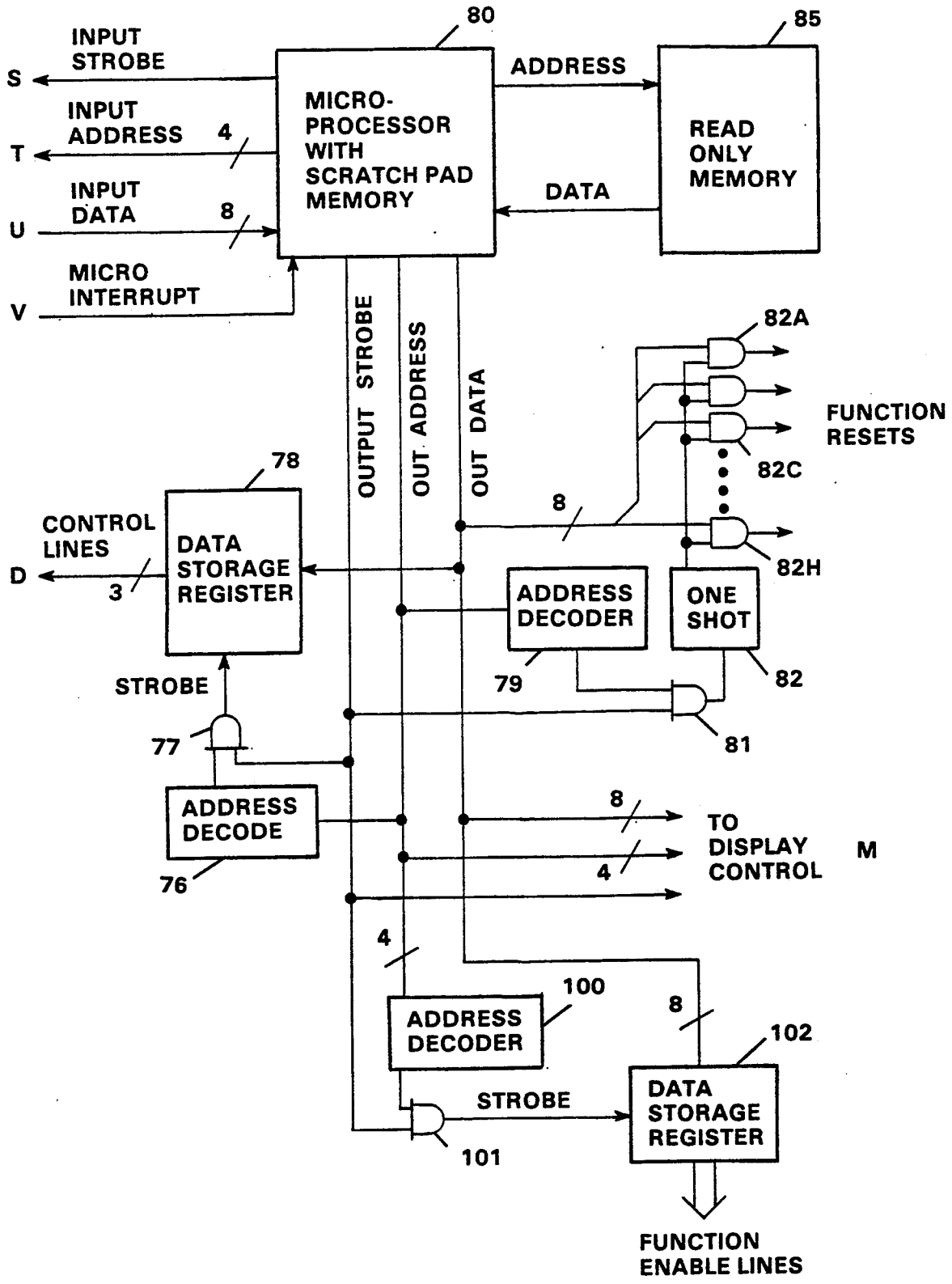

Referring now to FIGS. 5A and 5B, the operation sequencer will now be described. In FIG. 5A, four input lines from the mode state decoder 32 and five inputs from the debounced switch lines and the double and triple depression monitors 33 and 34 are illustrated. The former inputs are periodically sampled by the microprocessor in order to establish the mode of operation of the sequencer. The microprocessor 80 accomplishes this by presenting a unique address on its input address bus which is only decoded by address decoder 74*b*, the output of which is ANDed with the input strobe signal by AND gate 75*b* which, in turn, produces an enable signal for tri-state drivers 73*b*. As shown in FIG. 3A, the activation of mode select switch will have incremented counter 31 and that binary count will have been decoded to a signal indicative of the next of a pre-established sequence of operational modes. When the AND gate 75*b* produces the enable signal, the microprocessor reads the state of the output decoder by means of the input data bus, determines if the data represents a new or old mode, and sets up the functional circuits for the mode selected. Five additional signals in FIG. 5A whose information will be presented to the microprocessor 80 are ORed by OR gate 71 which detects an activation of any of the switches 7, 8 or 9, or depression monitors 33 or 34 and generates an interrupt signal for microprocessor 80 which responds by generating a unique read address and an input strobe. The input address is decoded by address decoder 74*a* which will generate an output for only a single input combination. This output is ANDed with the input strobe signal at AND gate 75*a* which generates a tri-state device enable signal. Because of the tri-state drivers, the input data lines of the microprocessor input bus may be connected to multiple sources as shown connected to both drivers 73*a* and 73*b*. As shown, any of the five signals from the switches and depression monitors 33 and 34 will "set" their associated latch 72 when the signal goes active. The previously described enable signal generated by AND gate 75 enables the contents of latches 72 to be transferred to the microprocessor data bus lines by way of tri-state drivers 73*a*. Thereafter, the latches 72 are cleared by one-shot 83 at a predetermined time after the occurrence of the enable signal. Depending on the content of this input, the microprocessor, cycling under the control of the programming in memory 85 will perform an operation or sequence of operations specified by the input. This operation will conclude with the generation of a signal on the output data bus, the output address bus and the output strobe line. Output address combinations can then be decoded by additional unique address decoders such as 76 to provide, when ANDed with the output strobe signal at AND gate 77 to enable updating of data stored in data register 78, the output of which controls the switch routing logic of FIG. 3A and 4 or enables the major functional circuits of the event registering device. Similarly, address decoder 79, gate 81 and one-shot 82 will yield a pulse when gated with the output data bus by means of gates 82*a*, 82*b*, . . . 82*h* to produce selective reset signals. Likewise the output data bus, address bus and strobe can control the output display logic 50 of FIG. 3C using yet another unique address code. Switchable functions noted as desireable above, including provision for omission of switches 7, 8 and 9 and control of memory for recall of associated event numbers and times, can be implemented in a similar way by providing an additional address decoder along with suitable programming in memory 85.

Figure 6:
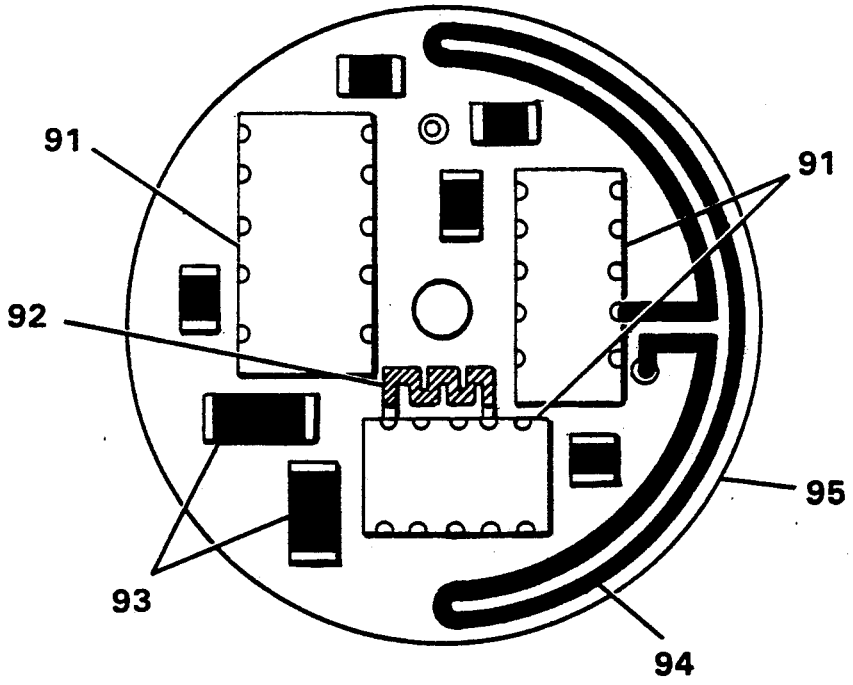
FIG. 6 is a diagram of a microwave transmitter embodiment of the digit switch according to one aspect of the invention.
Figure 7:
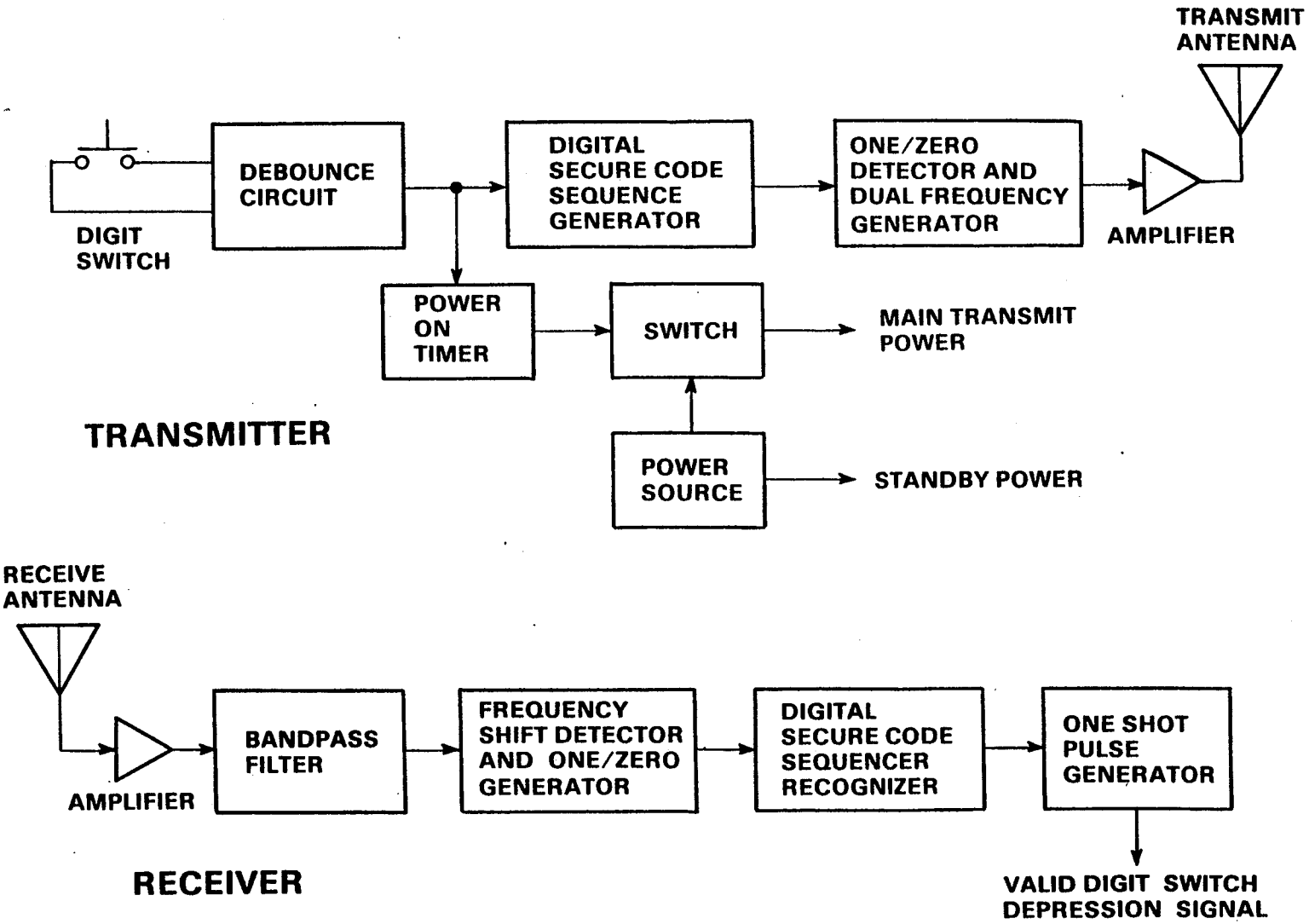
FIG. 7 is functional block diagram of the microwave transmitter of FIG. 6 and a corresponding microwave receiver.

Referring now to FIG. 6, an exemplary arrangement for providing a wireless link between digit switch module 2 and housing 5 is shown. In this arrangement, a miniaturized microwave transmitter can be provided on a printed circuit board having a transverse dimension comparable to the diameter of a human finger. Since it is contemplated, in this application, transmission range need not exceed six feet and may be as short as a few inches, power requirements are low and antenna size need not be great. The constitution and operation of microwave transmitters is well-understood and need not be repeated here. An exemplary functional block diagram of a suitable microwave transmitter and receiver is illustrated in FIG. 7. It will suffice for enablement of practice of this aspect of the invention that necessary microwave and digital integrated circuit chips 91, printed circuit elements such as resistor 92 and chip resistors or capacitors 93 can be laid out using hybrid technology on the printed circuit substrate 95 and a printed dipole antenna 94 can be formed on the edge of the board.

Figure 8:
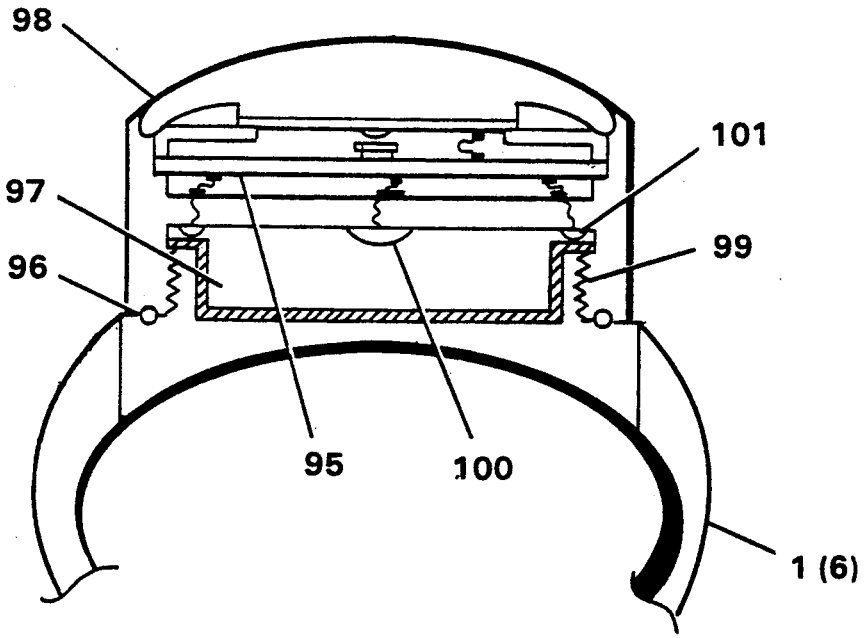
FIG. 8 is a cross-sectional view of a waterproof housing according to an aspect of the invention in an exemplary application to the digit switch module.

As is understood in the art, the microwave transmitter may be embodied by a microwave monolithic integrated circuit (MMIC) and would preferably operate in the 0.25 to 0.75 gigahertz range. Much of the circuit could also be printed of a Gallium Arsenide or sapphire substrate. The transmitter is also preferably arranged to require only standby power until the transducer of FIG. 8 is actuated. The receiver is also preferably implemented with MMIC technology. If deemed desireable, coding and decoding of the transmitted signal can also be provided in a manner well understood in the art to eliminate or limit interference from similar units being operated nearby.

The preferred waterproofing arrangement for the invention is shown at FIG. 8. As pointed out above, this arrangement is applicable to both the housing and the digit switch module and the exemplary illustration of this arrangement, as applied to the digit switch module will fully illustrate all salient features of the application of this arrangement to the housing, as well.

The essence of this arrangement is that the bottom of the housing or digit switch module is affixed to the strap 1, 6 or other means for attachment of the event register to the body or apparel of the operator. As seen in FIG. 8, the circuitry of the digit switch module 95 or the event monitor is formed in a hermetically sealed upper portion with a flexible dome 98 which is attached to a lower portion with a large diameter screw thread 99 and o-ring seal 96. A battery compartment 97 is thereby formed between the upper and lower portions of the digit switch module or the housing. In a manner well-known in the art, battery connections can readily be made by a wiper 100 in the upper portion cavity and through the lower portion, possibly, with a slip joint contact 101. While the screw thread and o-ring seal is very effective as a water resistant seal, hermetic sealing of the circuitry in the upper portion prevents water damage and limits battery leakage or corrosion damage to the same. Potential water penetration to the battery compartment may be easily removed. Therefore, in addition to providing convenience of battery replacement and good waterproofing characteristics, should water penetrate the device and cause malfunction thereof, the device can rapidly and conveniently be restored to operability. This approach also permits replacement of the strap with convenience and minimal cost. The arrangement would also allow convenient moving of the housing portion of the invention from a wrist strap to a half-glove or other means for wearing the device such as a lanyard or pinning or clipping device for attachment to the operators apparel.

Thus, it is seen that the invention provides an event register suitable for being worn on the body of an operator which allows actuation with the simplest of motions or even automatically during the performance of an activity and which is light in weight, waterproof and non-encumbering, in which information concerning an event can be stored in association with the event, in which the mode of operation can be altered during the performance of the activity by an action of the operator which will cause minimal interference with the activity, which provides a wireless transmitter and link suitable for use in a personal event counter and which has a convenient means of attachment of both the digit switch module and the housing of the invention to the body of the operator as a single unit.

While a preferred embodiment of the device has been disclosed and explained in detail above and many variations similarly disclosed and explained, other variations will become apparent to those skilled in the art. Different constitutions of logic and control circuitry as mentioned above, different communication links such as ultrasonic links, different transducers and of differing sensitivities for various applications such as piezoelectric devices, different power sources and different attachment means such as an elastic band permitting one or both the housing and the digit switch module to be worn as rings or even as a single ring are exemplary of such variations and the same are deemed to fall within the spirit and scope of the present invention which is to be limited only by appended claims.

We claim:

1. A register for recording the number of laps swum by a swimmer comprising:

a waterproof housing adapted to be worn on said swimmer's wrist;

signalling means adapted to be worn on one of said swimmer's fingers for generating a first signal upon completion of a lap by said swimmer;

counting means in said housing for receiving said first signal from said signalling means and for generating an output signal corresponding to the completion of said lap by said swimmer, wherein the time for swimming each such lap is greater than a specified minimum time;

display means in said housing for displaying the number of laps swum by said swimmer; and means for disabling said counting means for a time period after receiving said first signal, said time period being less than said minimum time.

2. The register of claim 1, wherein said counting means comprises a binary counter.

3. The register of claim 1, wherein said display means comprises:

a binary to binary-coded-decimal converter;

a plurality of light emitting diode drivers coupled to said converter; and a plurality of light emitting diodes, such of which is coupled to a corresponding one of said drivers.

4. The register of claim 1, herein said signalling means comprises a switch, said switch coupled to a power source, wherein said power source is connected to said counting means upon closure of said switch.

5. The register of claim 4, wherein said signalling means further comprises a debounce filter coupled between said switch and said counting means for preventing spurious connections of said power source to said counting means.

6. The register of claim 1, further comprising means for monitoring the elapsed time from the commencement of swimming by said swimmer.

7. The register of claim 6, further comprising means coupled to said monitoring means for coupling a signal corresponding to said elapsed time to said display means, wherein said elapsed time may be displayed in lieu of said number of laps.

8. The register of claim 1, wherein said signal producing means is coupled to said counting means by a wired link.

9. The register of claim 1, wherein said signalling means further comprises a microwave transmitter for transmitting said event signal to said counting means by microwaves.

10. The register of claim 1, wherein said housing is securable to a strap means for encircling the wrist of said operator.

11. The register of claim 1, wherein said signalling means includes at least one pressure transducer.

12. The register of claim 1, wherein said signalling means is activated by contact with one wall of a swimming pool.

* * * * *